US008853960B2

(12) United States Patent
Liao et al.

(10) Patent No.: US 8,853,960 B2
(45) Date of Patent: Oct. 7, 2014

(54) DIMMING CONTROL CIRCUIT AND METHOD FOR GENERATING ANALOG AND DIGITAL SIGNALS ACCORDING TO ONE ANALOG CONTROL SIGNAL

(75) Inventors: Chiawei Liao, San Jose, CA (US); Hsin-Kai Chiang, HsinChu (TW)

(73) Assignee: Richtek Technology Corporation, R.O.C., Chupei, Hsin-Chu (TW)

( * ) Notice: Subject to any disclaimer, the term of this patent is extended or adjusted under 35 U.S.C. 154(b) by 465 days.

(21) Appl. No.: 12/287,314

(22) Filed: Oct. 8, 2008

(65) Prior Publication Data

US 2009/0140666 A1 Jun. 4, 2009

(30) Foreign Application Priority Data

Nov. 29, 2007 (TW) ..... 96145445 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/291; 315/224; 315/307

(58) Field of Classification Search
USPC ..... 315/291, 307, 224, 312; 362/800
See application file for complete search history.

(56) References Cited

U.S. PATENT DOCUMENTS

| | | | | |
|---|---|---|---|---|
| 5,428,265 | A * | 6/1995 | Booth et al. | 315/158 |
| 2008/0055230 | A1 * | 3/2008 | Jang et al. | 345/102 |

* cited by examiner

*Primary Examiner* — Anh Tran
(74) *Attorney, Agent, or Firm* — Tung & Associates

(57) ABSTRACT

The present invention discloses a dimming control circuit and a method for generating analog and digital signals according to an analog control signal. The dimming control circuit according to the present invention comprises an input for receiving an analog control signal; a digital dimming circuit for receiving the analog control signal and generating a digital signal; an analog dimming circuit for receiving the analog control signal and generating an analog signal; and a power circuit enabled by the digital signal for converting a supply voltage to an output voltage according to the analog signal generated by the analog dimming circuit.

20 Claims, 5 Drawing Sheets

DIMMING CONTROL CIRCUIT AND METHOD FOR GENERATING ANALOG AND DIGITAL SIGNALS ACCORDING TO ONE ANALOG CONTROL SIGNAL

BACKGROUND OF THE INVENTION

1. Field of Invention

The present invention relates to a dimming circuit and a corresponding method, and more particularly, to a method and device for generating analog and digital dimming signals according to one analog control signal, for use in, e.g., an LED driver circuit.

2. Description of Related Art

As shown in FIG. 1, a typical prior art method for controlling LED brightness is to control the average current flowing through the LEDs (light emitting diodes) by the duty ratio of a digital dimming signal 101.

However, it is required to adjust the LED brightness in an analog manner in certain products. Under such circumstance, the analog input can only adjust the brightness, but can not provide any other function, nor can it provide a digital function. For example, if it is intended to adjust the LED brightness in the analog manner, and it is also desired to provide an enable function (e.g., to turn ON/OFF the LEDs), it is then required to provide both an analog input pin and a digital input pin EN, and corresponding circuits, to the driver circuit 10 shown in FIG. 1, which is obviously not cost-effective.

In view of the above, the present invention proposes a device and a method which is capable of generating analog and digital signals according to one analog control signal, to achieve a composite function of, e.g., dimming and ON/OFF control.

SUMMARY OF THE INVENTION

A first objective of the present invention to provide a dimming control circuit.

Another objective of the present invention to provide a method and device for generating analog and digital signals according to one analog control signal.

In accordance with the foregoing and other objectives, and from one aspect of the present invention, a dimming control circuit comprises an input for receiving an analog control signal; a digital dimming circuit for receiving the analog control signal and generating a digital signal; an analog dimming circuit for receiving the analog control signal and generating an analog signal; and a power circuit enabled by the digital signal for converting a supply voltage to an output voltage according to the analog signal generated by the analog dimming circuit.

From another aspect of the present invention, a method for generating analog and digital signals according to one analog control signal comprises: receiving an analog control signal; generating a digital signal according to the analog control signal; and generating an analog signal according to the analog control signal.

Preferably, the method further comprises: driving a subject circuit by the analog signal generated according to the analog control signal; and enabling the subject circuit by the digital signal generated according to the analog control signal.

Preferably, the method further comprises: supplying power by the subject circuit.

From yet another aspect of the present invention, a device for generating analog and digital signals according to one analog control signal comprises: an input for receiving an analog control signal; a first circuit for generating a digital signal according to the analog control signal; and a second circuit for generating an analog signal according to the analog control signal.

Preferably, the device further comprises a third circuit which is enabled by the digital signal generated by the first circuit and operates according to the analog signal generated by the second circuit. Preferably, the third circuit includes a power circuit supplying power to light emitting devices.

These and other features, aspects, and advantages of the present invention will become better understood with reference to the following description of preferred embodiments and accompanying drawings.

DESCRIPTION OF THE PREFERRED EMBODIMENTS

Figure 1:
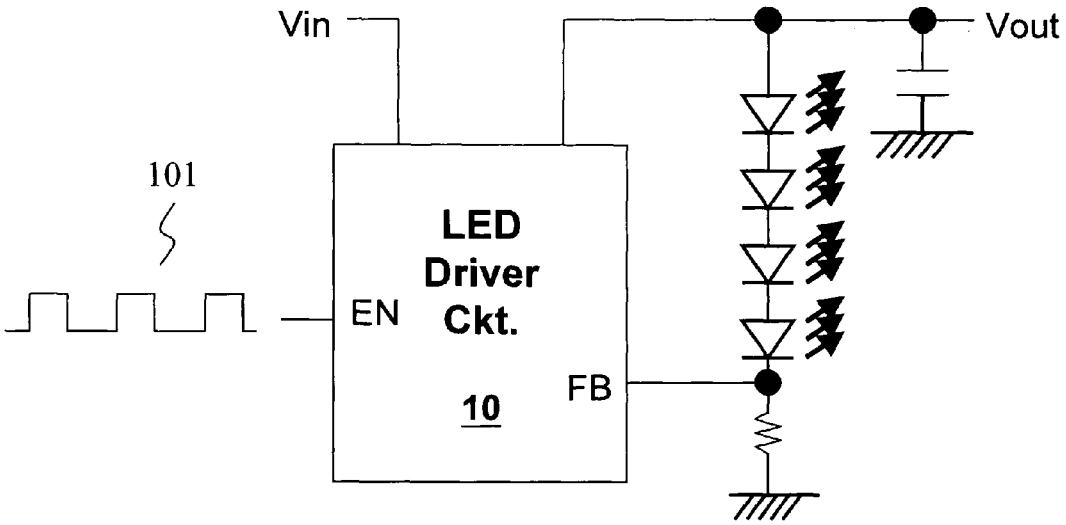
Fig. 1 (Prior Art)
FIG. 1 is a schematic circuit diagram showing a prior art circuit which controls the LED brightness in a digital manner.
Figure 2:
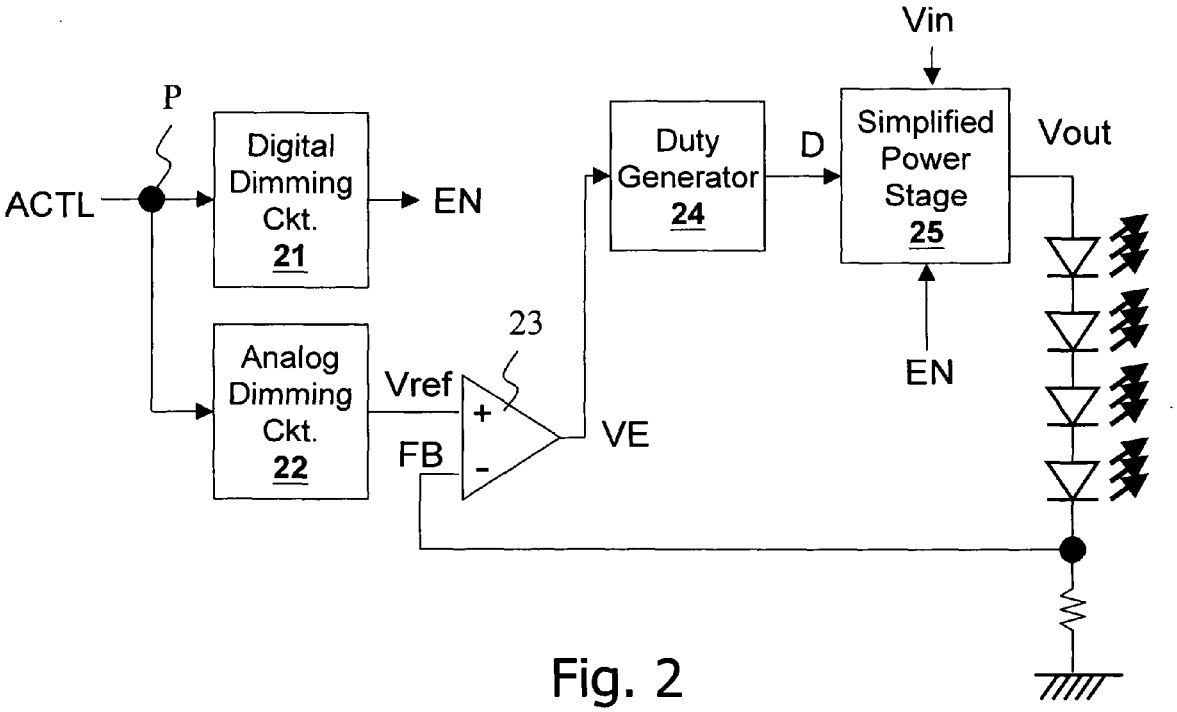
FIG. 2 is a schematic circuit diagram showing an embodiment of the present invention.

FIG. 2 is a schematic circuit diagram showing an embodiment according to the present invention. As shown in the figure, one single analog control signal ACTL is used in this invention to generate a digital signal EN and an analog signal Vref. Thus, if the LED driver circuit is an integrated circuit, only one pin P is required.

More specifically, in this embodiment, a digital dimming circuit 21 receives the analog control signal ACTL and generate the digital signal EN; an analog dimming circuit 22 receives the analog control signal ACTL and generate the analog signal Vref. The analog signal Vref is compared with a feedback signal FB in an error amplifier 23, to generate an analog error signal VE. The analog error signal VE is inputted to a duty generator 24, which generates a duty signal D that drives a simplified power stage 25 to convert a supply voltage Vin to an output voltage Vout. The output voltage Vout is supplied to the LEDs. The duty generator 24 may be embodied in various ways; for example, it can be a pulse width modulation circuit. In one embodiment, the simplified power stage 25 is controlled by the digital signal EN; it operates only when the digital signal EN enables it. The simplified power stage 25 for example may be a buck converter, boost converter, buck-boost converter, inverter, fly-back converter, etc., as shown in FIGS. 10A-10G. The operation of such circuits are well known to those skilled in this art, and therefore they are not redundantly explained here.

Figure 3:
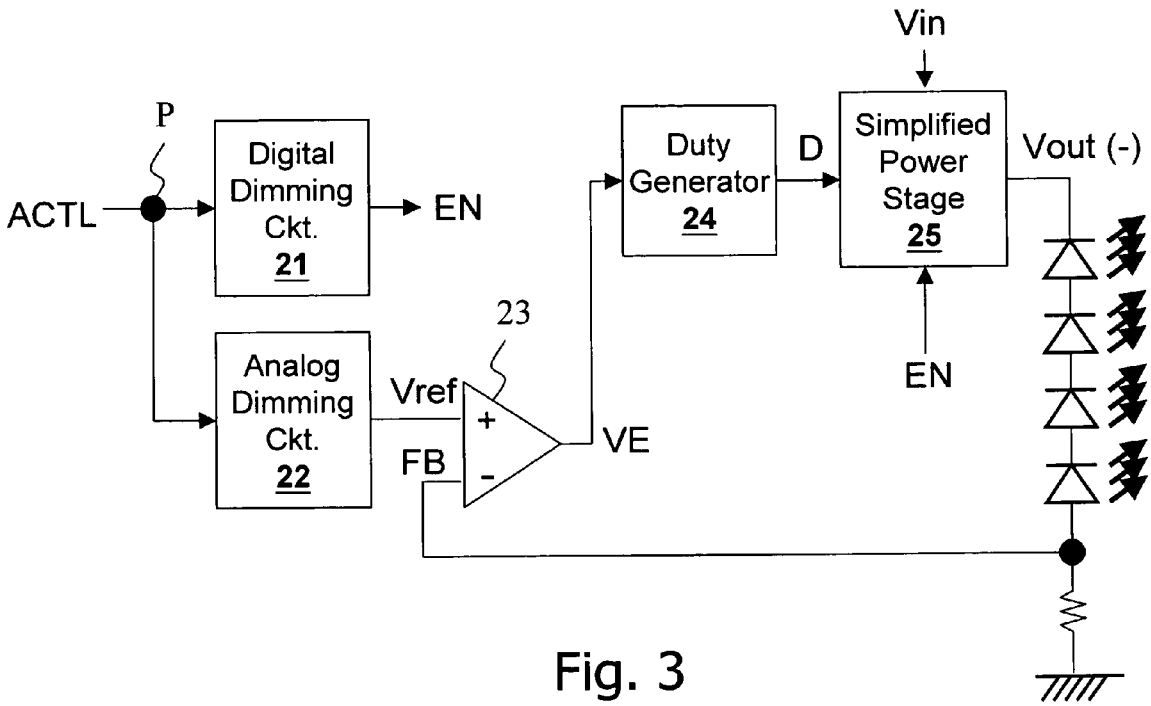
FIG. 3 shows another embodiment of the present invention.

In certain applications, the LEDs are connected in a reverse direction, and the simplified power stage 25 needs to output a negative voltage. FIG. 3 shows such an embodiment. The rest of the circuit is similar to that of the previous embodiment.

Figure 4:
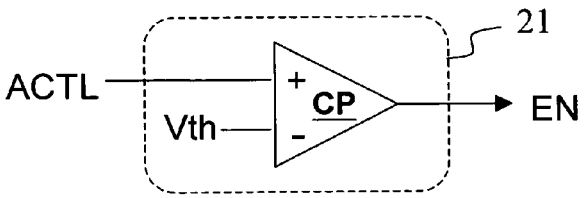
FIG. 4 shows an example of the digital dimming circuit.

The digital dimming circuit 21 generates the digital signal EN according to the analog control signal ACTL. FIG. 4 shows an embodiment of the digital dimming circuit 21. The analog control signal ACTL is compared with a reference voltage Vth in a comparator CP; when the analog control signal ACTL is higher than the reference voltage Vth, the comparator CP outputs a high-level signal, and when the analog control signal ACTL is lower than the reference voltage Vth, the comparator CP outputs a low-level signal.

Figure 11:
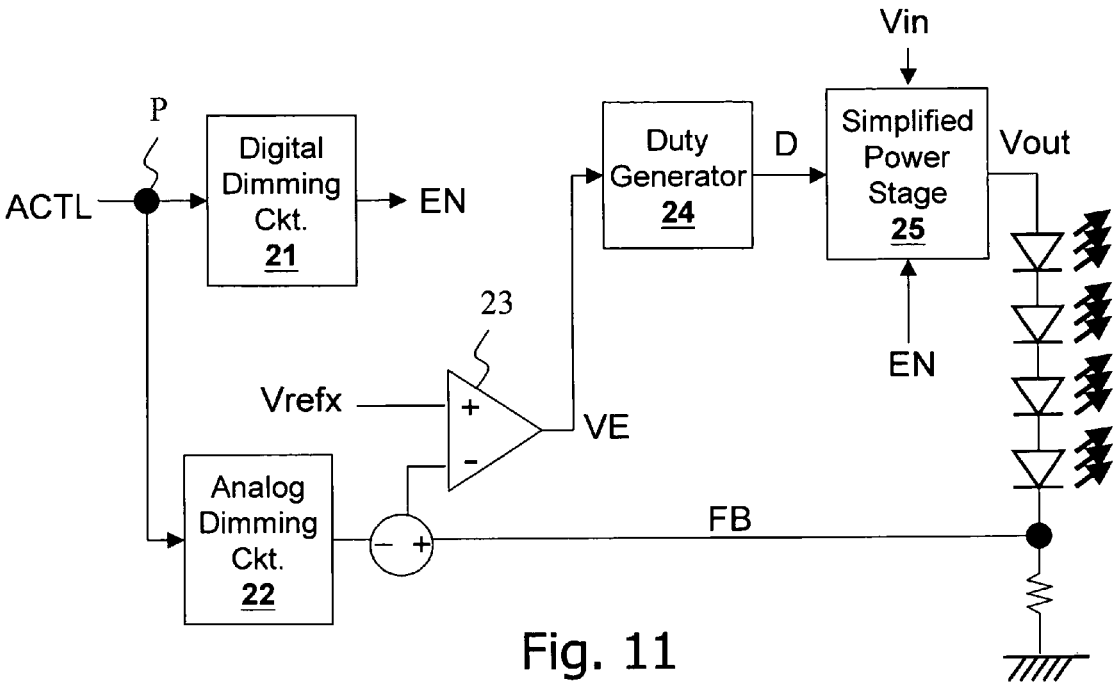
FIGS. 11 and 12 show two further embodiments of the present invention.
Figure 12:
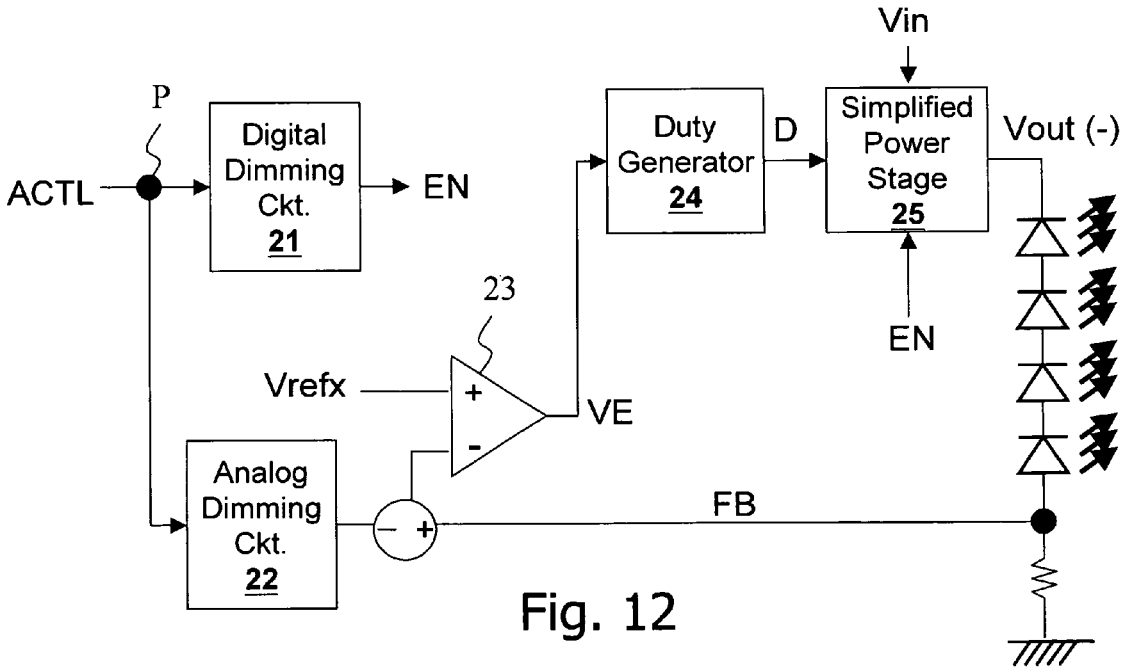

The function of the analog dimming circuit 22 is to generate a signal according to the analog control signal ACTL, and the signal should be capable of controlling the error amplifier 23 to generate a proper analog error signal VE. In the embodiments of FIGS. 2 and 3, the analog dimming circuit 22 receives the analog control signal ACTL and generates the analog signal Vref, which is sent to the positive input of the error amplifier 23; however, this is not the only arrangement to embody the present invention. As alternatives, referring to FIGS. 11 and 12, it can be arranged so that the negative output of the analog dimming circuit 22 is added with the feedback signal FB, and the result thereof is inputted to the negative input of the error amplifier 23, to be compared with a fixed reference voltage Vrefx inputted to the positive input of the error amplifier 23. A similar effect can also be achieved by such arrangements.

The following description is based on the analog dimming circuit 22 shown in FIGS. 2 and 3. However, under the teachings of the present invention, those skilled in this art can apply the same concept to other arrangements of the analog dimming circuit 22.

Figure 5:
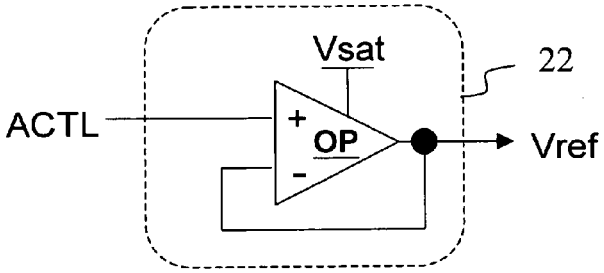
FIG. 5 shows an example of the analog dimming circuit.

FIG. 5 shows one embodiment of the analog dimming circuit 22. In this embodiment, the analog dimming circuit 22 includes an operational amplifier OP, which is supplied with a predefined working voltage Vsat. In other words, the operational amplifier OP also acts as a clamping circuit; under the working voltage Vsat, its output Vref follows the analog control signal ACTL, but when the analog control signal ACTL is higher than the working voltage Vsat, the output Vref will be kept as a constant Vsat.

Figure 8:
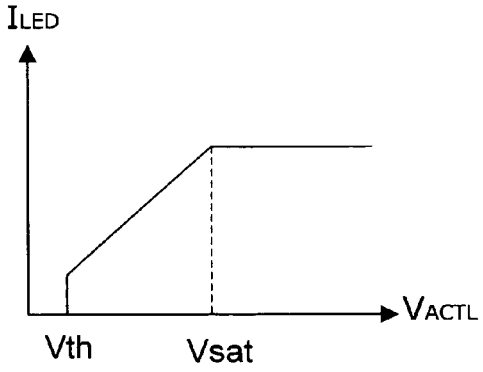
FIG. 8 shows the relationship between the input voltage $V_{ACTL}$ and the output current $I_{LED}$ of the overall circuit when employing the analog dimming circuit of FIG. 5.

When using the analog dimming circuit 22 as shown in FIG. 5, the relationship of the input voltage (i.e., the voltage of the analog control signal ACTL, $V_{ACTL}$) and the output current (i.e., the current flowing through the LEDs, $I_{LED}$) of the overall circuit is shown in FIG. 8. When the input voltage $V_{ACTL}$ is lower than the reference voltage Vth, the digital signal EN is low, and the simplified power stage 25 is thus inoperative; the output current is zero. When the input voltage $V_{ACTL}$ is higher than the reference voltage Vth, but lower than the voltage limit Vsat, the output current is approximately proportional to the input voltage. When the input voltage $V_{ACTL}$ is higher than the voltage limit Vsat, the output current is a constant. This provides an over current protection function for the output current.

In the above embodiment, any input voltage lower than the reference voltage Vth will not be able to provide any analog dimming function; that is, the brightness of the LEDs can not be adjusted below a certain extremely low range. It is OK because such extremely low range is not perceptible by human eyes. But in case it is necessary to do so, the analog dimming circuit 22 can be embodied as shown in FIG. 6 or FIG. 7.

Figure 6:
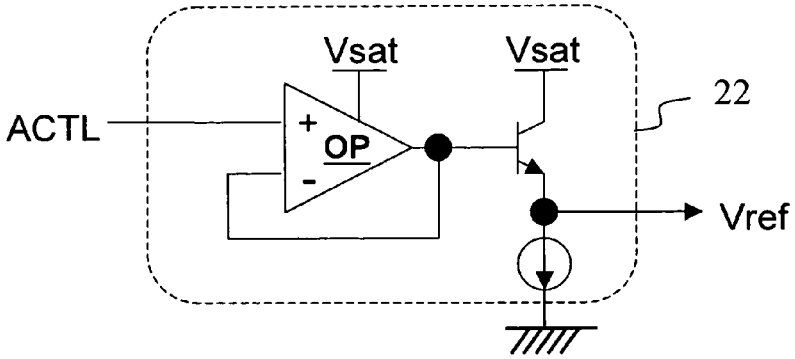
FIGS. 6 and 7 show two more examples of the analog dimming circuit.
Figure 7:
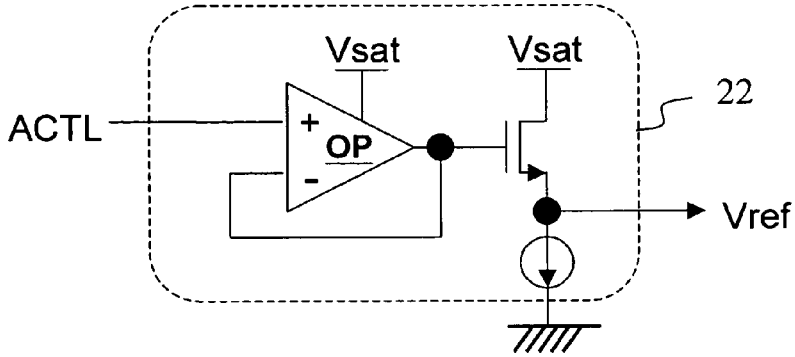
Figure 9:
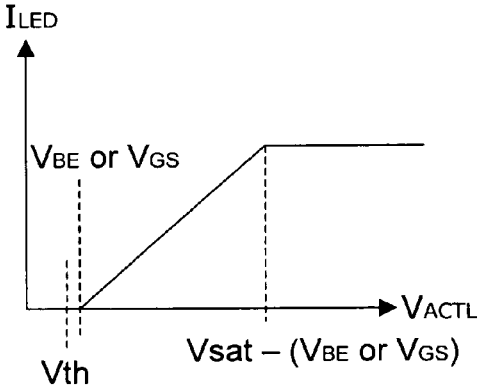
FIG. 9 shows the relationship between the input voltage $V_{ACTL}$ and the output current $I_{LED}$ of the overall circuit when employing the analog dimming circuit of FIG. 6 or FIG. 7.
Figure 10A:
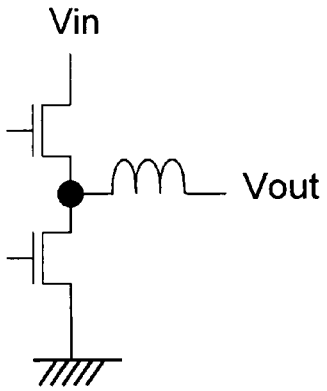
FIGS. 10A-10G show several examples of the simplified power stage.
Figure 10B:
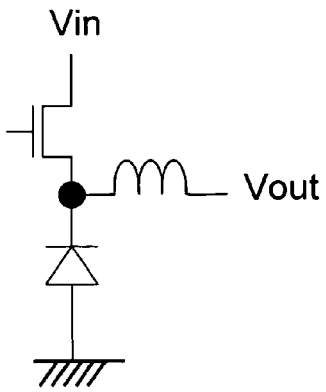
Figure 10C:
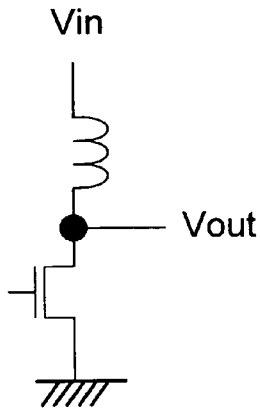
Figure 10D:
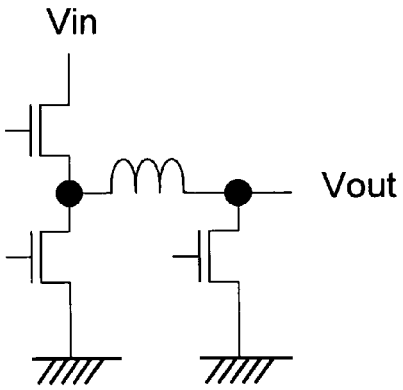
Figure 10E:
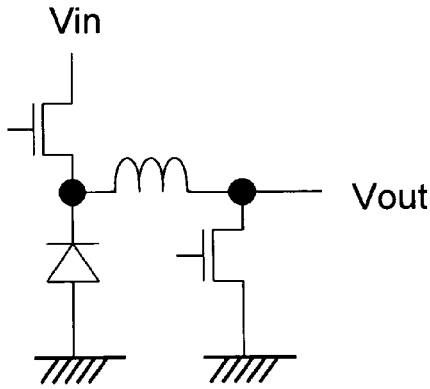
Figure 10F:
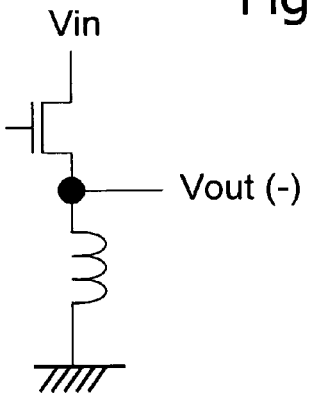
Figure 10G:
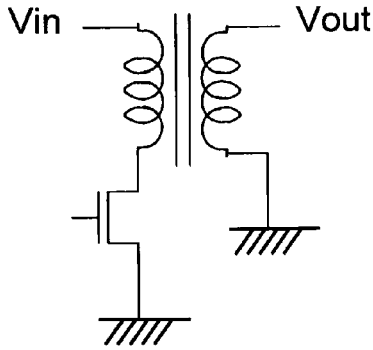

In the analog dimming circuit 22 shown in FIG. 6, there is a voltage drop $V_{BE}$ between the operational amplifier OP and the output Vref of the circuit, and thus the upper limit of the voltage Vref is decreased and becomes Vsat-$V_{BE}$. Similarly, in the circuit of FIG. 7, the upper limit of the voltage Vref is decreased and becomes Vsat-$V_{GS}$. The relationship of the input voltage $V_{ACTL}$ and the output current $I_{LED}$ of the overall circuit is shown in FIG. 9. The output current $I_{LED}$ can only be generated when the input voltage $V_{ACTL}$ is larger than $V_{BE}$ or $V_{GS}$; therefore, even in an extremely low range, the output current $I_{LED}$ is adjustable to control the LED brightness correspondingly. To this end, the reference voltage Vth should be set lower than $V_{BE}$ or $V_{GS}$, so that the purpose of adjusting the LED brightness in the extremely low range can be achieved. When the input voltage $V_{ACTL}$ is higher than $V_{BE}$ or $V_{GS}$, but lower than the upper limit Vsat-$V_{BE}$ (or Vsat-$V_{GS}$), the output current approximately proportional to the input voltage. When the input voltage $V_{ACTL}$ is higher than the upper limit Vsat-$V_{BE}$ (or Vsat-$V_{GS}$), the output current is a constant. Thus, the overall circuit not only provides the over current protection function, but also provides brightness adjustment function in an extremely low range.

Although the present invention has been described in considerable detail with reference to certain preferred embodiments, these embodiments are for illustrative purpose and not for limiting the scope of the present invention. Other variations and modifications are possible. For example, the present invention can be applied to not only the dimming circuit, but also all applications which requires to generate both digital and analog signals from one single analog control signal. As another example, in all of the embodiments, one can insert a circuit which does not affect the primary function of the overall circuit, between any two devices which are shown to be in direct connection. As a further example, the voltage drop can be achieved by various ways other than those shown in FIGS. 6 and 7. Therefore, all modifications and variations based on the spirit of the present invention should be interpreted to fall within the scope of the following claims and their equivalents.

What is claimed is:

1. A dimming control circuit, comprising:

an input for receiving an analog control signal;

a digital dimming circuit for receiving the analog control signal and generating a digital signal;

an analog dimming circuit for receiving the analog control signal and generating an analog signal; and a power circuit enabled by the digital signal for converting a supply voltage to an output voltage according to the analog signal generated by the analog dimming circuit, wherein the digital dimming circuit includes a comparator which compares the analog control signal with a first reference voltage.

2. A dimming control circuit, comprising:

an input for receiving an analog control signal;

a digital dimming circuit for receiving the analog control signal and generating a digital signal;

an analog dimming circuit for receiving the analog control signal and generating an analog signal; and a power circuit enabled by the digital signal for converting a supply voltage to an output voltage according to the analog signal generated by the analog dimming circuit, wherein the analog dimming circuit includes an operational amplifier which compares the analog control signal with the output of the operational amplifier.

3. The dimming control circuit of claim 2, wherein the operational amplifier is supplied with a predefined working voltage.

4. The dimming control circuit of claim 2, wherein the output of the operational amplifier is decreased by a voltage level, and the voltage-decreased signal is supplied as the output of the analog dimming circuit.

5. The dimming control circuit of claim 4, wherein the digital dimming circuit includes a comparator which compares the analog control signal with a first reference voltage, and wherein the voltage level by which the output of the operational amplifier is decreased is higher than the first reference voltage.

6. A dimming control circuit, comprising:

an input for receiving an analog control signal;

a digital dimming circuit for receiving the analog control signal and generating a digital signal;

an analog dimming circuit for receiving the analog control signal and generating an analog signal; and a power circuit enabled by the digital signal for converting a supply voltage to an output voltage according to the analog signal generated by the analog dimming circuit, wherein the power circuit includes an error amplifier having one end receiving the analog signal generated by the analog control signal, and the other end receiving a feedback signal which is relevant to the output voltage.

7. A dimming control circuit, comprising:

an input for receiving an analog control signal;

a digital dimming circuit for receiving the analog control signal and generating a digital signal;

an analog dimming circuit for receiving the analog control signal and generating an analog signal; and a power circuit enabled by the digital signal for converting a supply voltage to an output voltage according to the analog signal generated by the analog dimming circuit, wherein the power circuit includes an error amplifier having one end receiving a second reference voltage, and the other end receiving a difference between the analog signal generated by the analog control signal and a feedback signal which is relevant to the output voltage.

8. A method for generating analog and digital signals according to one analog control signal, comprising:

receiving an analog control signal;

generating a digital signal according to the analog control signal; and generating an analog signal according to the analog control signal, wherein the step of generating a digital signal includes: comparing the analog control signal with a reference voltage.

9. A method for generating analog and digital signals according to one analog control signal, comprising:

receiving an analog control signal;

generating a digital signal according to the analog control signal; and generating an analog signal according to the analog control signal, wherein the step of generating an analog signal includes: clamping the analog control signal below a predetermined voltage upper limit.

10. A method for generating analog and digital signals according to one analog control signal, comprising:

receiving an analog control signal;

generating a digital signal according to the analog control signal; and generating an analog signal according to the analog control signal, wherein the step of generating an analog signal includes: decreasing the analog control signal by a voltage level.

11. The method of claim 10, wherein the step of generating a digital signal includes: comparing the analog control signal with a reference voltage which is lower than the voltage level by which the analog control signal is decreased.

12. The method of claim 10, further comprising:

driving a subject circuit by the analog signal generated according to the analog control signal; and enabling the subject circuit by the digital signal generated according to the analog control signal.

13. The method of claim 12, further comprising: supplying power by the subject circuit.

14. The method of claim 13, wherein the power is supplied to one or more light emitting diodes.

15. A device for generating analog and digital signals according to one analog control signal, comprising:

an input for receiving an analog control signal;

a first circuit for generating signal according to the analog control signal; and a second circuit for generating an analog signal according to the analog control signal, wherein the first circuit compares the analog control signal with a reference voltage.

16. A device for generating analog and digital signals according to one analog control signal, comprising:

an input for receiving an analog control signal;

a first circuit for generating a digital signal according to the analog control signal; and a second circuit for generating an analog signal according to the analog control signal, wherein the second circuit clamps the analog control signal below a predetermined voltage upper limit.

17. A device for generating analog and digital signals according to one analog control signal, comprising:

an input for receiving an analog control signal;

a first circuit for generating a digital signal according to the analog control signal; and a second circuit for generating an analog signal according to the analog control signal, wherein the second circuit decreases the analog control signal by a voltage level.

18. The device of claim 17, wherein the first circuit compares the analog control signal with a reference voltage which is lower than the voltage level by which the analog control signal is decreased.

19. The device of claim 17, further comprising a third circuit which is enabled by the digital signal generated by the first circuit and operates according to the analog signal generated by the second circuit.

20. The device of claim 19, wherein the third circuit includes a power circuit which converts a supplied voltage to an output voltage according to the analog signal generated by the second circuit.

* * * * *